US006061835A

United States Patent [19]

Lien

[11] Patent Number: 6,061,835

[45] Date of Patent: May 16, 2000

[54] SHAPE-CHANGEABLE HAT

[76] Inventor: Jack Lien, No. 30, Yeh-Chi St., San-Min Dist., Kaohsiung, Taiwan

[21] Appl. No.: 09/400,978

[22] Filed: Sep. 22, 1999

[51] Int. Cl.[7] ..... A42B 1/00

[52] U.S. Cl. ..... 2/175.5; 2/209.13

[58] Field of Search ..... 2/175.5, 175.4, 2/175.1, 209.13

[56] References Cited

U.S. PATENT DOCUMENTS 213,846 4/1879 Smith ..... 2/175.5
1,378,977 5/1921 Parmley ..... 2/175.5
1,558,142 10/1925 Brenner ..... 2/175.5
5,915,533 6/1999 Halle ..... 2/175.5

*Primary Examiner*—Bibhu Mohanty
*Attorney, Agent, or Firm*—Birch, Stewart, Kolasch & Birch, LLP

[57] ABSTRACT

A hat having a resilient wire stretcher wrapped in the rim thereof along the border to stretch the brim into shape, and an endless binding cord mounted in the brim and surrounded by the resilient wire stretcher, the endless binding cord having a part extended out of an opening at the brim for pulling by hand to deform the brim and the resilient wire stretcher.

3 Claims, 3 Drawing Sheets

SHAPE-CHANGEABLE HAT

BACKGROUND OF THE INVENTION

The present invention relates to a hat for the head, and more particularly to a shape-changeable hat.

A variety of hats have been disclosed, and have appeared on the market. A hat may be used for protecting the head against rain or the radiation of the sun, or keeping the head warm. However, regular hat is not collapsible. When collapsed, the hat may be permanently deformed.

SUMMARY OF THE INVENTION

It is one object of the present invention to provide a hat, which can be adjusted to change its shape. It is another object of the present invention to provide a hat, which is collapsible. It is still another object of the present invention to provide a hat, which can be used as a flying toy. According to one aspect of the present invention, the hat comprises a resilient wire stretcher wrapped in the rim thereof along the border to stretch the brim into shape, and an endless binding cord mounted in the brim and surrounded by the resilient wire stretcher, the endless binding cord having a part extended out of an opening at the brim for pulling by hand to deform the brim and the resilient wire stretcher. According to another aspect of the present invention, counterweight means may be fastened to the resilient wire stretcher to stabilize the flying of the hat when the hat is used as a flying toy.

DETAILED DESCRIPTION OF THE PREFERRED EMBODIMENT

Figure 1:
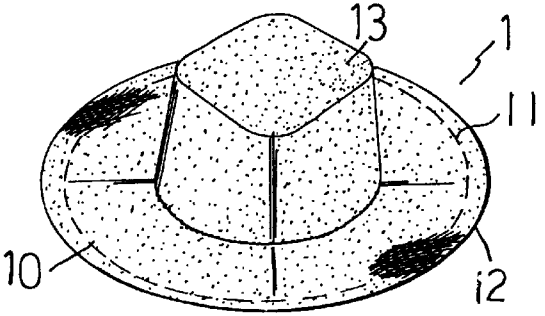
FIG. 1 is a perspective view of a hat according to the present invention.
Figure 2:
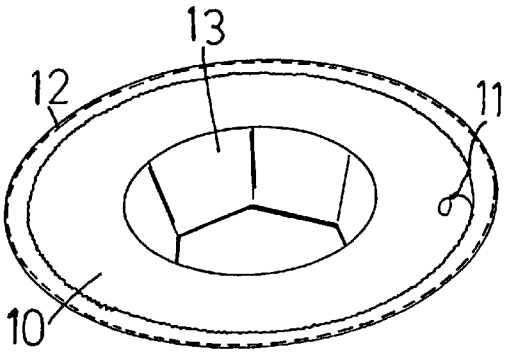
FIG. 2 is an oblique bottom view of the hat shown in FIG. 1.
Figure 3:
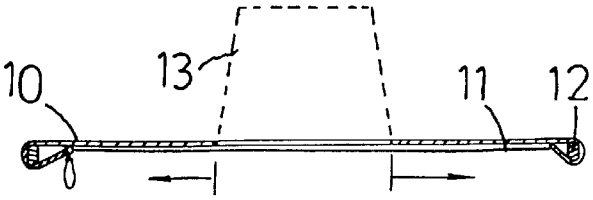
FIG. 3 is a schematic drawing showing the stretching direction of the resilient wire stretcher at the brim of the hat according to the present invention.
Figure 4:
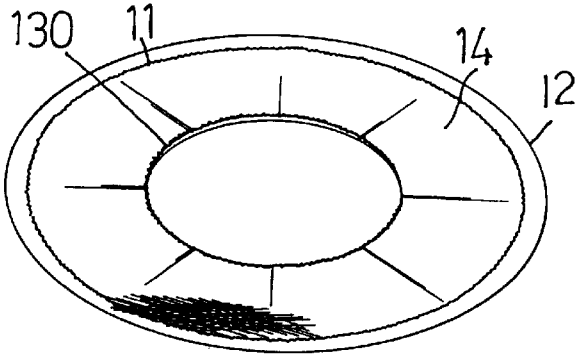
FIG. 4 is an oblique bottom view of an alternate form of the hat according to the present invention.

Referring to Figures from 1 through 4, a hat 1 is made of flexible fabric, comprising an annular brim 10, a crown 13 formed integral with the inner diameter 130 of the annular brim 10, a resilient wire stretcher 12 wrapped in the brim 10 along the border to stretch the brim 10 into shape, and an endless binding cord 11 mounted in the brim 10 around the inner diameter 130 and surrounded by the resilient wire stretcher 12. The crown 13 may be variously shaped (see FIGS. 1 and 6). The endless binding cord 11 has a part extended out of an opening at the bottom panel of the brim 10 for pulling by hand.

Figure 5:
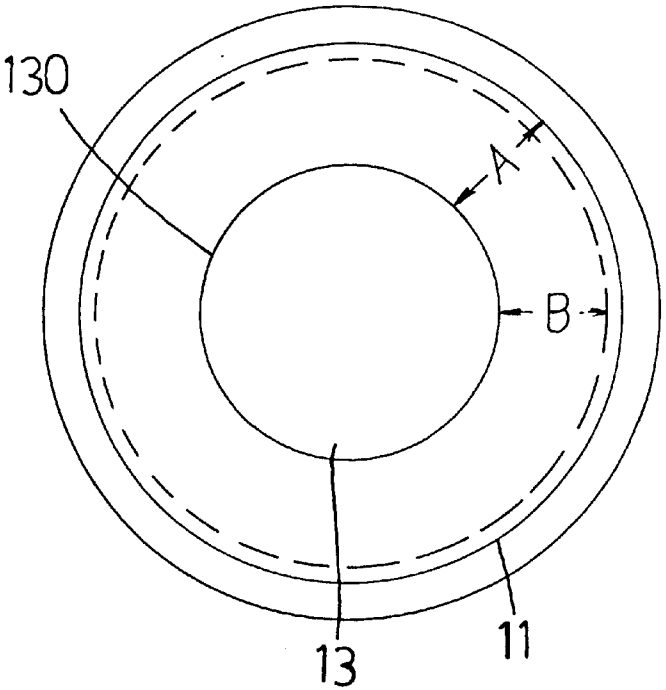
FIG. 5 is a schematic drawing showing the adjustment of the hat according to the present invention.
Figure 6:
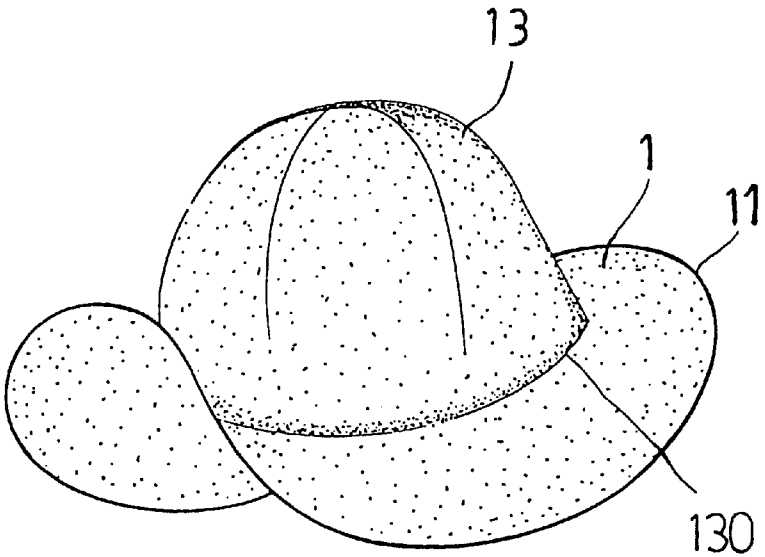
FIG. 6 shows the brim of the hat deformed according to the present invention.

Referring to FIGS. 5 and 6 and Figures from 1 through 4 again, when the endless binding cord 11 is pulled outwards and tied up at the desired distance from the pulling end to shorten the distance between the inner diameter 130 of the annular brim 10 and the endless binding cord 11 from distance A to distance B, the resilient wire stretcher 12 is deformed, thereby causing the shape of the brim 10 to be changed.

Figure 8:
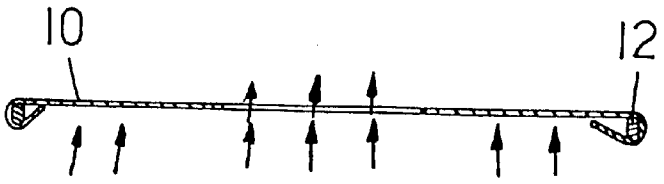
FIG. 8 is a schematic drawing showing the flying of the hat in the air according to the present invention.
Figure 7:
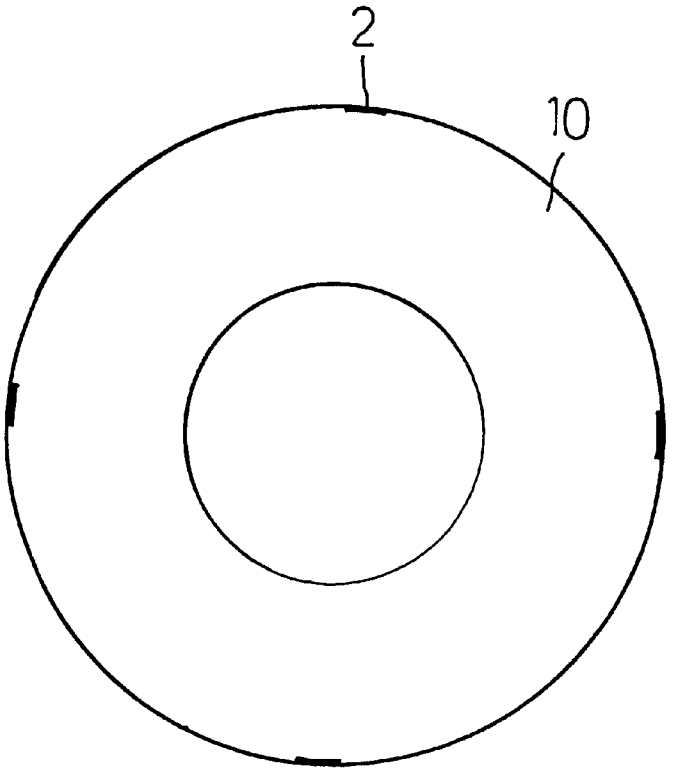
FIG. 7 shows counterweights fastened to the resilient wire stretcher at the border area of the brim of the hat according to the present invention.

Referring to FIGS. 7 and 8, a counterweight or a number of counterweights 2 may be mounted on the brim 10 to keep the brim in a flat manner, so that the hat can be used as a flying toy.

What is claimed is:

1. A hat comprising a resilient wire stretcher wrapped in a brim thereof along the border to stretch said brim into shape, and an endless binding cord mounted in said brim and surrounded by said resilient wire stretcher, said endless binding cord having a part extended out of an opening at said brim for pulling by hand to deform said brim and said resilient wire stretcher.

2. The hat of claim 1 further comprising counterweight means fastened to said resilient wire stretcher at said brim.

3. The hat of claim 1 wherein said resilient wire stretcher is fixedly fastened to said brim by stitches.

* * * * *